United States Patent [19]

Sekozawa et al.

[11] Patent Number: 4,792,905

[45] Date of Patent: Dec. 20, 1988

[54] METHOD OF FUEL INJECTION CONTROL IN ENGINE

[75] Inventors: Teruji Sekozawa, Machida; Makoto Shioya, Tokyo; Hiroatsu Tokuda, Katsuta; Motohisa Funabashi, Sagamihara; Mikihiko Onari, Kokubunji, all of Japan

[73] Assignee: Hitachi, Ltd., Tokyo, Japan

[21] Appl. No.: 861,996

[22] Filed: May 12, 1986

Related U.S. Application Data

[63] Continuation of Ser. No. 635,411, Jul. 30, 1984, abandoned.

[30] Foreign Application Priority Data

Aug. 8, 1983 [JP] Japan ..... 58-144620

[51] Int. Cl.[4] ..... F02M 51/00

[52] U.S. Cl. ..... 364/431.05; 123/480; 123/478

[58] Field of Search ..... 364/431.05, 431.06; 123/478, 480, 440, 489

[56] References Cited

U.S. PATENT DOCUMENTS

| | | | |
|---|---|---|---|
| 4,123,999 | 11/1978 | Asano | 123/489 |
| 4,357,923 | 11/1982 | Hideg | 123/480 |
| 4,437,340 | 3/1984 | Csere et al. | 123/440 |
| 4,438,496 | 3/1984 | Ohie | 364/431.05 |
| 4,537,172 | 8/1985 | Kanehara et al. | 123/478 |
| 4,548,185 | 10/1985 | Pozniak | 364/431.06 |
| 4,604,703 | 8/1986 | Hasegawa | 364/431.05 |

*Primary Examiner*—Parshotam S. Lall

*Attorney, Agent, or Firm*—Antonelli, Terry & Wands

[57] ABSTRACT

A method of controlling the quantity of fuel to be injected into an intake manifold for an engine by a fuel injection unit comprising the steps of identifying parameters indicative of a change in the dynamic characteristic of the fuel supply system due to changes in the environmental conditions including the atmospheric pressure and engine temperature, estimating the quantity of fuel to be supplied to the engine cylinder on the basis of the identified parameters, and controlling the quantity of fuel to be injected so that the ratio between the measured quantity of air supplied to the engine cylinder and the estimated quantity of fuel supplied to the engine cylinder attains the desired air-fuel ratio.

1 Claim, 3 Drawing Sheets

METHOD OF FUEL INJECTION CONTROL IN ENGINE

This is a continuation of application Ser. No. 635,411, filed July 30, 1984, now abandoned.

This invention relates to a method of fuel injection control in an engine, and, more particularly, to a method suitable for controlling the ratio between the quantities of air and fuel supplied to an engine.

A prior art method of fuel injection control in an engine includes feeding back an information output from an air-fuel ratio sensor, which senses the air-fuel ratio of the air-fuel mixture supplied to the engine, and determining the quantity of fuel to be injected by a fuel injection unit on the basis of the information of the sensed air-fuel ratio and the information of the quantity of air supplied to the engine, as indicated by an output from an air flow meter, an engine intake-manifold pressure sensor or an engine rotation speed sensor. Such a control method is disclosed in, for example, "Engine Control" reported in the Journal of the Institute of Electrical Engineers of Japan, Vol. 101, No. 12 or "Modern Electronically Controlled Cars" reported in the Journal of the Society of Instrument and Control Engineers of Japan, Vol. 21, No. 7.

However, the above-described prior art method of fuel injection control has a drawback in that the quantity of fuel actually supplied to the cylinder of the engine tends to be subject to a change resulting in impossibility of attainment of the desired air-fuel ratio due to the fact that part of the fuel injected in atomized form is deposited as a fuel film on the inner wall surface of the intake manifold along which the air and fuel are supplied to the engine, and such a fuel film is subsequently vaporized (or gasified).

Further, the information provided by the air-fuel ratio sensor tends to be retarded from the actual or present data due to a transportation delay time of the exhaust gases in the exhaust manifold of the engine from which the air-fuel ratio sensor detects the air-fuel ratio of the air-fuel mixture being supplied to the engine, and the dynamic characteristic of the fuel supply system associated with the intake manifold is also subject to a change under influence of, for example, the atmospheric pressure and the temperature of the engine. Accordingly, a method of fuel injection control which takes these factors into account is in demand.

With a view to avoiding prior art drawbacks, it is a primary object of the present invention to provide a method of fuel injection control in an engine, which can maintain the air-fuel ratio of the air-fuel mixture supplied to the engine at the desired value regardless of any change of the dynamic characteristic of the fuel supply system and the presence of a retarded flow of exhaust gases in the exhaust manifold.

In accordance with the present invention, there is provided, in an engine control apparatus in which the quantity of fuel injected by fuel injection means is controlled to maintain the air-fuel ratio at the desired value in dependence upon an information output from an air-fuel ratio sensor sensing the air-fuel ratio between the quantities of air and fuel supplied to a cylinder of an engine and an information output from an air flow meter, an intake manifold pressure sensor or an engine rotational speed sensor indicating the quantity of air supplied to the engine cylinder, a method of fuel injection control provides the steps of identifying parameters indicative of a change in the dynamic characteristic of the fuel supply system due to changes in the environmental conditions by making necessary computations on the signals indicative of the air-fuel ratio, the quantity of supplied air and the engine rotational speed together with the signal indicative of the quantity of fuel injected by the fuel injection means, using the parameters identified in the first step to estimate the quantity of fuel actually supplied to the engine cylinder due to an observation delay from the air-fuel ratio sensor owing to a retarded flow of exhaust gases in the exhaust manifold, and controlling the quantity of fuel to be injected by the fuel injection means so that the ratio between the measured quantity of air supplied to the engine cylinder and the estimated quantity of fuel supplied to the engine cylinder attains the desired air-fuel ratio.

The present invention will be apparent from the following detailed description taken in conjunction with the accompanying drawings, in which.

Figure 1:
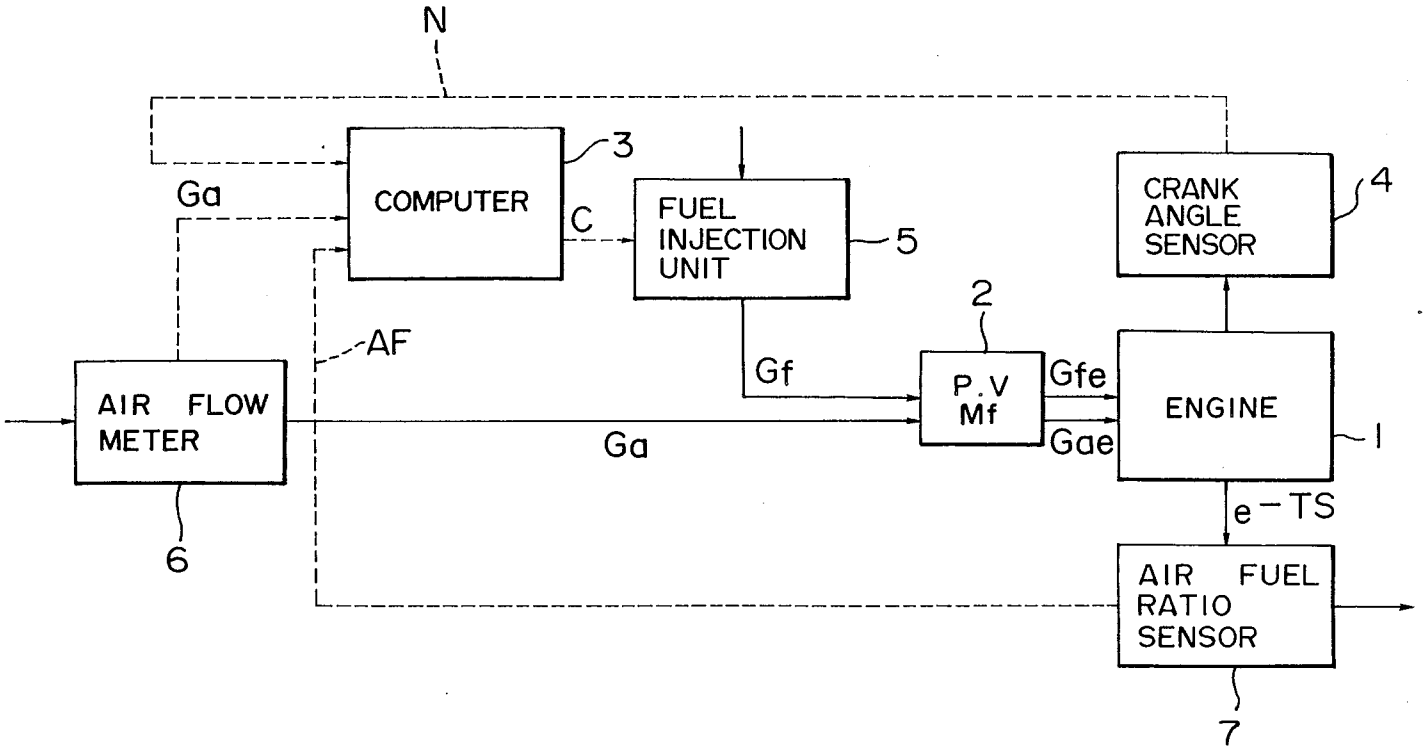
FIG. 1 is a block diagram of a fuel control apparatus for an engine to which an embodiment of the present invention is applied.

Referring now to the drawings wherein like reference numerals are used throughout the various views to designate like parts and, more particularly, to FIG. 1, according to this figure, data N, Ga and AF indicative of the rotational speed of an engine 1, sensed by a crank angle sensor 4, the flow rate of intake air, metered by an air flow meter 6, and the air-fuel ratio sensed by an air-fuel ratio sensor 7 (an $O_2$ sensor), respectively are applied to a computer 3. On the basis of this input data, the computer 3 determines the quantity of fuel to be injected by a fuel injection unit 5, computes the on-off periods of the fuel injection unit 5 and applies a command signal C indicative of the computed on-off periods of the fuel injection unit 5 so that the ratio between the quantity of air Gae(k) and the quantity of fule Gfe(k) supplied to the engine at time k attains the desired air-fuel ratio $AR^r(k)$. (k) is an arbitrary point in time.

However, a problem arises in connection with the above manner of fuel injection control by the computer 3. The problem is attributable to the fact that, while air and fuel are being supplied to the engine 1 through an intake manifold 2, part of fuel in atomized form deposits on the inner wall surface of the intake manifold 2 to form a fuel film thereon, and this fuel film is vaporized later, with the result that the quantity of fuel actually supplied to the engine 1 tends to differ from the desired value.

In order to solve the above problem, it is necessary to study the characteristics of the air supply system, fuel supply system and exhaust gas system. The air flow in the air supply system, fuel flow in the fuel supply system and retarded flow of exhaust gases in the exhaust gas system, which are the objects of control, can be expressed as follows:

AIR SUPPLY SYSTEM

The quantity Ga of air flowing through the intake manifold per unit time is expressed as a differential equation of the intake manifold pressure P as follows:

$$Ga = a_1 \cdot P \cdot N + a_2 \cdot V \frac{dP}{dt} \quad (1.1)$$

The quantity Gae of air supplied to the engine cylinder per unit time is given by the following equation:

$$Gae = a_1 \cdot P \cdot N \quad (1.2)$$

FUEL SUPPLY SYSTEM

The quantity Gfe of fuel supplied to the engine cylinder per unit time is given by the following equation:

$$Gfe = (1 - X)Gf + \frac{Mf}{\tau} \quad (2.1)$$

The fuel film model of the deposit on the inner wall surface of the intake manifold is given by the following equation:

$$\frac{dMf}{dt} = X \cdot Gf - \frac{Mf}{\tau} \quad (2.2)$$

The retarded flow of the exhaust gases is expressed as follows:

$$L(Gae/Gfe) = e^{-T \cdot S} \quad (3)$$

In the equations (1.1) to (3), N is the rotational speed of the engine; V is the volume of the intake manifold; $a_1$ and $a_2$ are constants determined by the type of the engine; Gf is the quantity of injected fuel; Mf is the fuel film mass; X is the fuel deposition rate; $\tau$ is the time constant of vaporization; L is the Laplacian; T is the time elapsed between the time at which the fuel is injected into the intake manifold and the time at which the air fuel ratio sensor senses the air fuel ratio of the exhaust gas flow in the exhaust manifold, S is the Laplace's operator; and P is the intake manifold pressure.

When an intake manifold pressure sensor is not provided in the air supply system, and the quantity of supplied air cannot be detected, the quantity of supplied air is estimated in a manner as described presently.

A discrete representation of the equation (1.1) provides the following equation in which the fuel injection time interval is taken as the sampling period for the purpose of expression in terms of the discrete time, that is, the sampling period is $\Delta t(k)$:

$$\hat{P}(k) = \frac{a_2 V}{a_1 N(k) + a_2 V} \hat{P}(k-1) + \frac{1}{a_1 N(k) + a_2 V} Ga(k) \quad (4.1)$$

where P(o)=Po, and Po is 1 atm. The symbol " " as used above and throughout the specification represents an estimated value calculated by mathematical calculation.

Thus, from the equation (1.2), the estimated value Gae(k) of the quantity of air supplied to the engine cylinder at time k is given by the following equation:

$$\hat{G}ae(k) = a_1 \cdot \hat{P}(k) \cdot N(k) \quad (4.2)$$

Figure 2:
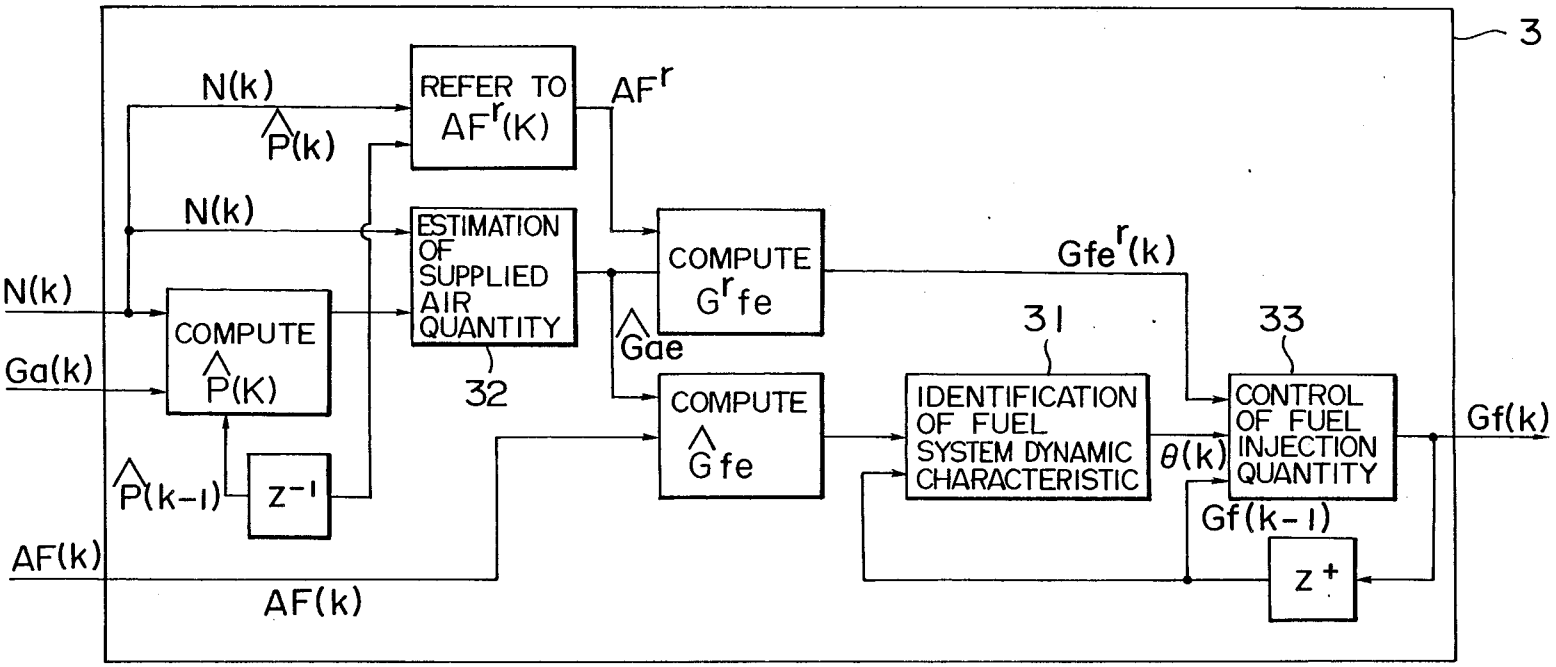
FIG. 2 is a block diagram illustrating the functions of the computer of in FIG. 1.

This computation is done carried out in supplied air quantity estimating block 32 shown in FIG. 2. When the intake manifold pressure sensor is present, and the intake manifold pressure P(k) can be sensed, the estimated value $\hat{G}ae(k)$ can be computed from the equation (4.2).

From the desired air-fuel ratio $AF^r(k)$ and equation (4.2), the desired quantity $G^rfe(k)$ of fuel to be supplied to the engine cylinder at time k is given by the following equation:

$$\hat{G}^r fe(k) = \frac{\hat{G}ae(k)}{AF^r(k)} \quad (5)$$

The quantity Gf(k) of fuel to be injected by the fuel injection unit 5 at time k must be determined so as to satisfy the equation (5) which provides $G^rfe(k)$. The dynamic characteristic of the fuel injection system is as expressed by the equations (2.1) and (2.2). However, because of the fact that the film deposition rate X is influenced by the factors including the atmospheric pressure, and the vaporization time constant $\tau$ is also influenced by the factors including the temperature of the engine, it is difficult to simply detect the state of the deposited fuel film. Further, the retarded flow of exhaust gases in the exhaust manifold will result in an observation delay of the quantity Gfe of fuel supplied to the cylinder.

When the dynamic characteristic of the fuel supply system and the retarded flow of exhaust gases in the exhaust manifold are taken into consideration, the engine fuel system has a pulse transfer function as shown by a block diagram in FIG. 3, with the transfer function being expressed as a difference equation including unknown parameters, as follows:

$$\hat{G}fe(k) = A_1 \cdot \hat{G}fe(k-1) + B_1 \cdot Gf(k-1) + B_2 \cdot Gf(k-d-1) \quad (6)$$

where:

$$\hat{G}fe(k) = \frac{\hat{G}ae(k-d)}{AF(k)} \quad (7)$$

$$A_1 = \frac{1}{1 + \frac{1}{\tau'(k)}},$$

$$B_1 = \frac{1 + \frac{1}{\tau} - X}{1 + \frac{1}{\tau'(k)}},$$

$$B_2 = \frac{X - 1}{1 + \frac{1}{\tau'(k)}} \quad (8)$$

d as described below is a discrete delay in time from the point of time T.

In the equation (7), AF(k) represents the air-fuel ratio observed at time k, and $\hat{G}ae(k-d)$ represents the estimated quantity of air supplied to the cylinder at time (k−d) and is given by an equation similar to the equation (4.2). Since the quantity Gfe(k) of fuel supplied to the cylinder at time k cannot be directly observed or measured, the air-fuel ratio AF(k) observed at time k and the estimated quantity $\hat{G}ae(k-d)$ of air supplied to the cylinder at time (k−d) are substituted in the equation (7) to compute the value of $\hat{G}fe(k)$. The discrete time delay d is computed from the following relation:

$$[d - T/\Delta T] \quad (9)$$

where [ ]is a Gauassian notation for obtaining an integer, where T represents the delay time of the transporation delay time of exhaust gases in the exhaust manifold as measured from time k and is computed from the variables including the quantity of supplied air and the rotation speed of the engine. In the equation (8), $\tau'(k)=\tau/\Delta t(k)$.

Figure 3:
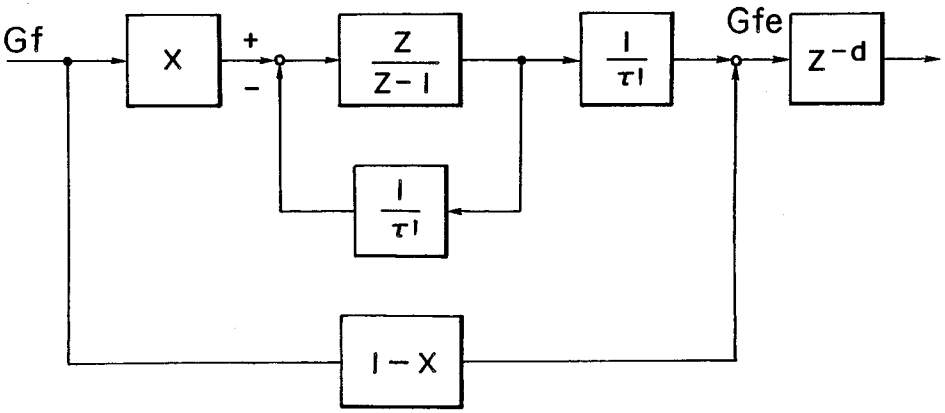
FIG. 3 is a block diagram of the fuel supply system or a discrete-time representation for the fuel supply system.

In FIG. 3, the symbol Z indicates the Z-transformation for finding the value of the output of the fuel supply system at the sampling time.

The difference equation (6) teaches that the output at time k is the estimated quantity $\hat{G}fe(k)$ of supplied fuel when the input is the quantity Gf of injected fuel, and it includes the unknown parameters $A_1$, $B_1$ and $B_2$ which are functions of the fuel deposition rate x and the vaporization rate $1/\tau$. These unknown parameters $A_1$, $B_1$ and $B_2$ are estimated as follows by the use of, for example, an implicit least square method:

$$\left\{\begin{array}{lcl} Z(k) & = & [\hat{G}fe(k-1), Gf(k-d), Gf(k-d-1)]^T \\ \hat{\theta}(k) & = & [A_1(k), \hat{B}_1(k), \hat{B}_2(k)]^T \\ \epsilon(k) & = & \hat{G}fe(k) - Z^T(k)\hat{\theta}(k-1) \end{array}\right\} \quad (10)$$

$$\hat{\theta}(k) = \hat{\theta}(k-1) + \frac{F(k-1)Z(k-1)}{1 + Z^T(k-1)F(k-1)Z(k-1)}\epsilon(k) \quad (11)$$

$$F^{-1}(k) = \lambda_1 F^{-1}(k-1) + \lambda_2 Z(k)\, Z^T(k) \quad (12)$$

where: $0<\lambda_1\leqq 1$, and $0\leqq\lambda_2<2$.

The above computation is carried out in a block 31 shown in FIG. 2 provided for identifying the dynamic characteristic of the fuel supply system for the engine. F(k) represents an adaption gain calculated at time k. F(k) is a matrix and $F^{-1}(k)$ represents an inverse marix of matrix F(k) of the adaption gain.

Gf(k) represents the quantity of fuel to be injected at time k must be determined on the basis of the unknown parameters estimated in the manner above described, so that $\hat{G}fe(k)$ can attain the desired value $G^rfe(k)$. However, observation is delayed by the discrete delay time d. The method of adaptive control commonly employed in various fields of control is such that a future value of a reference model is prepared or estimated when the operation of a system includes a time delay, and the present step of control proceeds to follow the estimated future values. However, in the case of the engine control under consideration, the desired future value $G^rfe$ of the estimated quantity $\hat{G}fe$ of fuel supplied to the cylinder is determined by future values of the engine rotational speed and intake manifold pressure which, in turn, are determined by the factors including the accelerator pedal displacement and the load. Therefore, the desired future value $G^rfe$ of $\hat{G}fe$ cannot be previously set. To deal with such a situation, the following equation is employed for the purpose of control in the present invention, noting the fact that any appreciable change does not occur in the parameters during the discrete delay time d due to slow changes of the atmospheric pressure and engine temperature during the time delay d:

$$\hat{G}fe(k)=\hat{A}_1(k)\hat{G}fe(k-1)+\hat{B}_1(k)Gf(k)+\hat{B}_2(k)Gf(k-1) \quad (13)$$

The equation (13) is similar to the equation (6) except that the discrete time delay d is excluded from the latter. That is, the output Gfe(k) in the equation (13) represents the estimated quantity of fuel considered to be fed into the engine cylinder at time k, whereas, the output Gfe(k) in the equation (6) represents the estimated quantity of fuel derived from the observed value.

Since the desired value $G^rfe(k)$ of the quantity of supplied fuel at time k is given by the equation (5), the relationship given by, for example, the following equation is selected as the performance index at time k, for the sake of simplicity:

$$G^rfe(k)-\hat{G}fe(k)=G^rfe(k)-(\hat{A}_1(k)\hat{G}fe(k-1)+\hat{B}_1(k)Gf(k)+\hat{B}_2(k)Gf(k-1)=0 \quad (14)$$

On the basis of the relationship given by the equation (14), a fuel injection control block 33 shown in FIG. 2 computes the manipulated variable (the fuel injection quantity) given by the following equation:

$$Gf(k) = \frac{G^rfe(k) - (\hat{A}_1(k)\hat{G}fe(k-1) + \hat{B}_2(k)Gf(k-1))}{\hat{B}_1(k)} \quad (15)$$

In the equation (15), $\hat{G}fe(k-1)$ is the value of Gfe included in the equation (3) and estimated at time (k−1).

In the manner above described, the dynamic characteristic of the fuel supply system changing with changes in the atmospheric pressure, engine temperature, etc. is identified, and the quantity of injected fuel is controlled on the basis of the result of identification, so that the ratio between the quantities of air and fuel actually supplied to the engine cylinder can be maintained at the desired value thereby minimizing the quantity of toxic components produced due to incomplete combustion of fuel. Thus, the above manner of air-fuel ratio control not only clears the servere restrictions on engine exhaust gases but also realizes the desired increase in the torque output as well as the desired decrease in the fuel consumption.

It will be understood from the foregoing detailed description that the present invention can deal with a change in the dynamic characteristic of the fuel supply system and a retarded flow of exhaust gases in the exhaust manifold so that the ratio between the quantities of air and fuel actually supplied to the cylinder of the engine can be maintained at the desired value.

We claim:

1. In an engine control apparatus in which a quantity of fuel injected by fuel injection means is controlled to maintain a desired air-fuel ratio wherein said engine control apparatus operates in response to an output from an air-fuel ratio sensor sensing the air-fuel ratio between quantities of air and fuel to be supplied to a cylinder of an engine, and an output from an engine rotation speed sensor, the method comprising the steps of:

identifying unknown parameters in a transfer function of the fuel supply system in which the dynamic characteristic of the fuel supply system and the retarded flow of exhaust gases are factors, said unknown parameters being based on the fuel deposition rate and the time constant of fuel vaporization wherein said transfer function defines a model of the fuel supply system in accordance with a sensed air-fuel ratio, the quantity of the suction air, intake manifold pressure, engine rotational speed and the quantity of fuel injected;

estimating the quantity of fuel supplied to the cylinder on the basis of the unknown parameters obtained from said identifying step and the delay of time representing the time elapsed between the time at which a quantity of fuel is injected into the cylinder of said engine and the time at which said sensed air-fuel ratio is detected by said air-fuel ratio sensor due to a retarded flow of exhaust gases; and controlling the quantity of fuel to be injected by said fuel injection means so that the air-fuel ratio between the estimated quantity of air to be supplied to the cylinder and the estimated quantity of fuel supplied to the cylinder attains a desired air-fuel ratio.

* * * * *